United States Patent [19]

Hall

[11] Patent Number: 4,570,726

[45] Date of Patent: Feb. 18, 1986

[54] CURVED CONTACT PORTION ON ENGAGING ELEMENTS FOR ROTARY TYPE DRAG BITS

[75] Inventor: David R. Hall, Provo, Utah

[73] Assignee: Megadiamond Industries, Inc., Provo, Utah

[21] Appl. No.: 707,536

[22] Filed: Mar. 4, 1985

Related U.S. Application Data

[63] Continuation of Ser. No. 433,048, Oct. 6, 1982, abandoned.

[51] Int. Cl.[4] ..... E21B 10/48

[52] U.S. Cl. ..... 175/410; 175/329

[58] Field of Search ..... 175/329, 330, 410, 374, 175/379

[56] References Cited

U.S. PATENT DOCUMENTS

| | | | |
|---|---|---|---|
| 2,033,594 | 3/1936 | Stoody | 175/410 |
| 3,811,520 | 5/1974 | Frenkel et al. | 175/410 |
| 4,108,260 | 8/1978 | Bozarth | 175/410 |
| 4,109,737 | 8/1978 | Bovenkerk | 175/329 |
| 4,333,540 | 6/1982 | Daniels et al. | 175/329 |
| 4,334,586 | 6/1982 | Schumacher | 175/374 |

FOREIGN PATENT DOCUMENTS

| | | | |
|---|---|---|---|
| 1340987 | 9/1963 | France | 175/413 |
| 679193 | 12/1964 | Italy | 175/330 |
| 466315 | 7/1975 | U.S.S.R. | 175/374 |
| 791889 | 12/1980 | U.S.S.R. | 175/410 |

*Primary Examiner*—James A. Leppink
*Assistant Examiner*—Hoang C. Dang
*Attorney, Agent, or Firm*—Neuman, Williams, Anderson & Olson

[57] ABSTRACT

An improvement in the design of engaging elements for drag type rotary drill bits is disclosed which consists of forming the abrasive-faced contact portion into curved shapes. An advantage of this engaging element is provided by the curved surface's tendency to direct the loosened material to the side of the contact portion. This self-cleaning action extends the life of engaging elements by reducing unnecessary regrinding of the already loosened material and by improving the engaging elements' ability to dissipate heat. Another advantage of this engaging element is that as it passes through the material the curved surface will exert stresses on the material differing in magnitude, direction and/or type at each point of the curve and thereby produce increased straining of the material. An increased straining of the material is especially desirable when drilling in shale or other plastic formations since it causes increased chipping of the material which aids in the removal of the material from the hole. The distal surface of the contact portion of these engaging elements is not coated with the abrasive and therefore will wear away in controlled fashion relative to the abrasive faced contact portion making the cutting edges of the contact portion self-sharpening.

2 Claims, 13 Drawing Figures

FIG. 1A
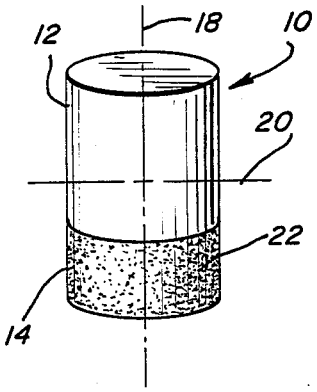
FIG. 1B
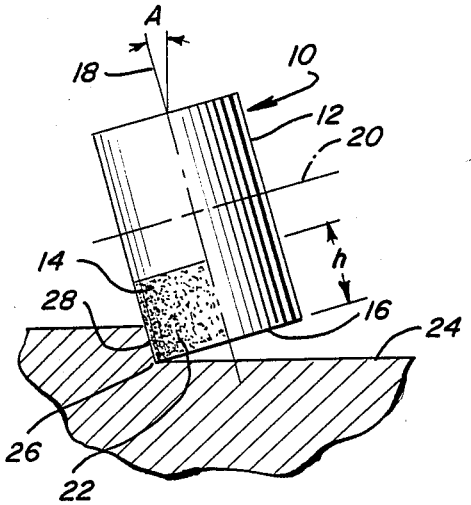
FIG. 1C
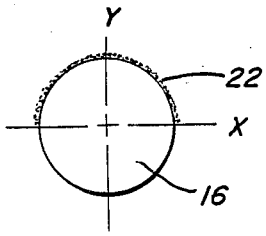
FIG. 2A
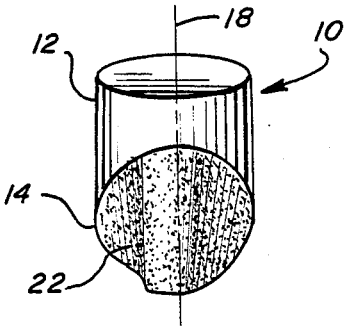
FIG. 2B
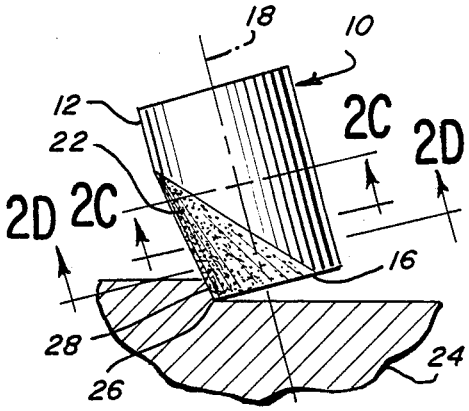
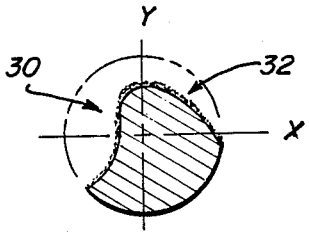
FIG. 2C
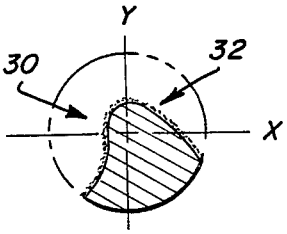
FIG. 2D

CURVED CONTACT PORTION ON ENGAGING ELEMENTS FOR ROTARY TYPE DRAG BITS

This application is a continuation of application Ser. No. 433,048, filed Oct. 6, 1982, now abandoned.

BACKGROUND OF THE INVENTION

1. Field of the Invention

This invention relates to engaging elements for drag type rotary drill bits. More particularly, the invention is the shape of the contact face portion of a drill bit engaging element upon which a super hard abrasive material such as diamond, cubic boron nitride, a combination of the two, or similar material is deposited.

Throughout the following disclosure the term "abrasive" is intended to cover all abrasive materials including but not limited to synthetic diamond, cubic boron nitride, polycrystalline diamond, polycrystalline cubic boron nitride, and combinations thereof. The type of abrasive material placed on the contact face of the drill bit engaging element does not form any part of this invention, so long as it is harder and more wear-resistant than the material forming the body of the drill bit engaging element.

2. Prior Art

The application of abrasive material such as sintered polycrystalline diamond compacts to the contact portion or working surface of the engaging element in rotary type drag bits has extended the life expectancy of the drag bits and also allowed the design and development of rotary type drag bits with more aggressive cutting actions and resultant faster penetrations rates. At present the rotary type drag bits for drilling in either soft or brittle formations include an engaging element with abrasive material deposited on a planar working surface. This planar working surface or contact portion of the engaging element is positioned at a slight negative angle from the perpendicular with respect to the material contacted. Through the rotary action of the bit, the contact portion is dragged or moved across the material. A problem with this planar shape for the contact portion is that the loosened material flows normal to it and is not encouraged in any particular direction. Therefore, the loosened material tends to back up against the contact portion or working surface. Recent bit designs include positioning the engaging elements so that they have a slight side rake in an effort to create a snow plow effect. However, even these new designs are not effective in preventing the material from backing up against the working surface since pressures against the working surface of these designs actually encourage a back-up of material. While in original and the new designs the material will eventually find its way off the outer edges of the working surface, the build-up of material causes numerous detrimental effects.

One detrimental effect resulting from this build-up on the working surface is an increase in wear to the surface caused by the unnecessary and wasteful regrinding of this already loosened material.

Another detrimental effect caused by material backing up on the working surface of the engaging element is a decrease in the initial contact force the engaging element has on new material. When there is a constant layer of ground material backed up on the working surface, it serves as a cushion and actually softens the impact that the engaging element has as it moves into the new material. This is especially critical when drilling in shale or other plastic materials where it is necessary to severely strain the plastic material in order for it to be broken up and removed from the hole.

Yet another detrimental effect of this build-up of material is that it increases the temperatures to which the engaging element is subjected. Higher temperatures are critical when dealing with abrasive material such as polycrystaline diamond since crystal degradation can occur at temperatures as low as 700° C. Any build-up of loosened material on the working surface of the engaging element acts to insulate the engaging element both from the cooling action of the drilling fluid and from the natural cooling action that occurs when the engaging element is continually contacting new material. This insulation is detrimental since it greatly reduces the engaging element's ability to dissipate the heat that is continuously being added to it through the scraping of the distal surface of the contact portion on the bottom of the hole.

The detrimental effect of heat is intensified when drilling in shale or similarly soft formations since under the high pressures and temperatures of drilling the shale becomes tacky or plastic. Accordingly, the build-up of loosened material on the working surface of the engaging element is increased since the tacky material will not readily glide or move off of the working surface as do the small particles which form when a more brittle rock is drilled.

Numerous attempts have been made to alleviate the problem of build-up on the working surface of the engaging element. Several patents disclose drill bit designs which include special hydraulic features such as nozzles, jets, or channels specifically positioned to wash the working surface of the engaging elements and encourage a particular direction of flow for the loosened material. (See U.S. Pat. No. 4,246,977 for Diamond Studded Insert Drag Bit with Strategically Located Hydraulic Passages for Mud Motors issued to James Allen on Jan. 27, 1981; U.S. Pat. No. 4,303,136 for Fluid Passage Formed by Diamond Insert Studs for Drag Bits issued to Harry Ball Dec. 1, 1981; also U.S. Pat. No. 4,334,585 for Insert Retention and Cooling Apparatus for Drag Bits issued to Robert G. Upton June 15, 1982.).

Even without this build-up of material on the face of the engaging element, the planar shape contact portion and the new designs are inefficient with respect to the cooling through hydraulics. Principles of heat transfer and fluid dynamics teach that the convection heat transfer coefficient for a body passing through a fluid varies greatly depending on the shape of the body. Planar faces having fluid flowing normal to them are among the least effective at convective cooling in the fluid. This result is caused in part by the stagnation layer in the fluid that is set up against the working surface.

A recent attempt at facilitating the removal of the material from the working surface of the engaging element is disclosed in the U.S. Pat. No. 4,333,540 in which the contact portion of the bit insert is formed by the intersection of two planar working faces. The cutting face of the contact portion looks like a triangle or wedge. However, there are specific problems which this triangular shape encounters when drilling in shale or other plastic materials. Under the pressure and temperature of drilling, shale tends to become plastic, therefore, although the triangle shape moves the loosened material to the outside of the contact portion of the engaging element, the sharp point of the wedge shaped contact portion will have more of an affect of simply parting the plastic-like shale, tending to form a groove rather than to cause any significant break up of material. This gentle parting action does not produce the strain needed to break up the shale for subsequent removal from the drilling hole.

Another attempt at improving drill bits by changing the contact portion of the drill bit insert is disclosed in U.S. Pat. No. 4,241,798 for Drilling Bits for Plastic Formations issued to Kenneth Jones on Dec. 30, 1980. The Jones patent recognizes the problems encountered in drilling through shale or other plastic-like formations and discloses the need for removing the plastic-like material from the drill hole in such a way as to prevent its reattachment to the bottom or side of the hole. Jones provides an opening in the face of the contact portion of the drill bit insert through which the material is extruded, thereby breaking it into small particles and allowing the drilling fluid to flush the extruded material from the drill hole. The opening in the face of the contact portion reduces the mechanical strength of the contact portion itself which could lead to fracture under the high pressure and temperature conditions experienced during drilling. Furthermore, hard particles can plug the opening in the contact portion and prevent its operation.

OBJECTS OF THE INVENTION

It is, therefore, a general object of the present invention to cope with the aforementioned problems. It is another general object to provide an abrasive-faced contact portion of a drilling or drag bit engaging element shaped in such a way as to move loosened material away from the material-engaging face of the contact portion of the drill bit engaging element. It is another general object to provide an abrasive-faced contact portion of a drilling bit engaging element shaped to direct material flow in a predetermined direction while altering the consistency or texture of the loosened material, making the loosened material easier to remove from the drilling hole. It is another general object to provide a drill bit engaging element with an abrasive-faced contact portion which is self-sharpening.

It is a specific object to provide a drill bit engaging element with an abrasive faced contact portion which is curved in such a way that this curve will force the loosened material away from the engaging area of the contact face thus providing for longer wear and improved heat dissipation. It is another specific object to provide a drill bit engaging element with an abrasive-faced curved contact portion in which the curved surface is symmetrical about the vertical axis of the drill bit engaging element. It is still another specific object to provide a drill bit engaging element with an abrasive-faced curved contact portion in which the curved surface is non-symmetrical about the vertical axis of the drill bit engaging element in order to direct the loosened material in a predetermined direction. It is yet another specific object to provide a drill bit engaging element with an abrasive-faced curved contact portion in which the curved surface is either symmetrical or non-symmetrical about the vertical axis of the drill bit engaging element and the radius of curvature from the center point of the drill bit engaging element to the curved surface of the contact portion differs for corresponding points on the surface in different horizontal planes perpendicular to the vertical axis of the drill bit engaging element. It is yet another specific object to provide a drill bit engaging element with an abrasive-faced curved contact portion which exerts differing magnitudes, directions and/or types of stress from point to point along the curved surface causing the magnitude, direction and/or type of strain in the material engaged to vary from point to point, both as it is initially contacted and also as it traverses the contact face, thereby causing the material to break up or chip for easier removal from the drilling hole. It is yet another specific object to provide a drill bit engaging element having the abrasive material deposited upon the surface of the contact face of the engaging element but not on the distal surface of the engaging element, thereby providing for self sharpening of the intersection between the contact surface and the uncoated distal surface as the less wear-resistant material of the distal surface wears more rapidly than the abrasive material on the contact face. It is yet another specific object of this invention to provide a drag bit engaging element with an abrasive-faced contact portion which allows the abrasive-faced engaging element to be attached to a stud of a preselected length, thus lending greater flexibility in the design of such rotary type drag bits to account for such parameters as the desired depth of the cutting profile.

These and other objects will become apparent as a detailed description proceeds.

SUMMARY OF THE INVENTION

The present invention is a drag bit engaging element with an abrasive-faced curved contact portion. The curved contact portion increases the life expectancy of the bit and increases the penetration rate of the bit especially in shale or other plastic materials. It should be noted that the drag bit engaging element of the present invention can be used efficiently in material formations other than shale or plastic-like material but that the greatest benefit of the invention is obtained when drilling in these shale or plastic like formations. In the simplest form the contact face portion of the engaging element is uniformly and symmetrically curved having the appearance of a right circular cylinder. A drill bit engaging element having an abrasive-faced contact portion shaped in this manner readily moves loosened material away from the contact portion since the material flows rearward along the smooth curved wall surface. In addition, the curvature of the abrasive faced contact portion is advantageous since as it passes through the formation, it produces stresses differing in magnitude, direction and/or type at each point along the curved surface which results in strains differing in magnitude, direction and/or type in the material in contact with the curved surface. This type of action is particularly desirable when drilling through shale or other plastic formations where creating these strains in the plastic-like material causes it to chip and assume a granular texture that is easily removed from the drilling hole, particularly by standard hydraulic methods.

In another embodiment of the invention, the abrasive-faced contact portion has a symmetrical shape about the vertical axis of the engaging element but the radius of curvature in any horizontal plane perpendicular to the vertical axis varies in length from point to point across the surface of the contact portion. This symmetrically curved shape with varying radii of curvature also causes variations in the magnitude, direction and/or type of stress from point to point along the curved surface and thus produce the desired changes in magnitude, direction and/or type of strain in the material which increase the drill bit's effectiveness especially in drilling plastic formations.

In another embodiment of the invention the abrasive-faced contact portion of the drill bit engaging element has a non-symmetrical contour about the vertical axis of the engaging element. The non-symmetrical contour of the contact portion forces the loosened material away from the work area of the contact portion and also directs the flow of loosened material in a predetermined direction. After being loosened, while traversing the curve defined by the shape of the contact portion, the material is still subjected to the stresses differing in magnitude, direction and/or type, thus producing the desired additional straining of the loosened material. The exact shape of the contact portion can also be used to determine the flow of the loosened material and as such can be used to direct the material flow toward special channels or other features of the bit which facilitate flushing from the drill bit.

In yet another embodiment of the invention either the symmetrical or non-symmetrical abrasive-faced contact face portion has differing radii of curvature measured from the center point of the engaging element to a corresponding point on the curved contact face portion in different horizontal planes perpendicular to the vertical axis. In this embodiment a vertical cross section shows that the working surface is non-parallel to the vertical axis. In the simplest form of this embodiment, the contact portion is in effect tapered, however, more complicated geometric shapes are feasible and contemplated. The shape of the contact portion with different radii of curvature in different horizontal planes also aids in directing material flow and provides for additional changes in the magnitude, direction and/or type of stress applied to the material thus producing additional strain in the material.

In each of the above forms of the invention the abrasive material is deposited only upon the outer surface or peripheral surface of the contact portion and not upon the distal surface. The distal surface is made of a less wear-resistant substance than the abrasive material. In the preferred embodiment, the body of the engaging element is made of cemented tungsten carbide which is less wear resistant than the abrasive material. In use the carbide wears away from the distal surface of the contact portion in a controlled fashion, being protected to a certain extent by the abrasive. The result is that the relative exposure of the abrasive edge to the carbide support remains substantially constant in use, thereby maintaining the sharpness of the edge between the abrasive and the distal surface of the contact portion. The sharpness of this particular edge is desirable since it greatly enhances the ability of the drill bit to penetrate new material by keeping the area through which the contact portion impacts the new material relatively constant in contrast with the increase in area that would occur if the distal end were covered allowing the cutting edge to become rounded by use.

In the preferred embodiment, the engaging elements are in the form of inserts which attach to rotary type drag bits. In an alternative embodiment the engaging element is attached by its back to a particular feature on the drilling crown itself. In another alternative embodiment the engaging element is secured to a feature on a stud which is in turn secured in a hole in the drilling crown. Other means of securing the engaging element to the drill bit are contemplated and are considered within the scope of the invention. It should also be mentioned that this invention is not limited by any particular means of producing these curved engaging elements. The desired shape may be obtained directly by coating that specific shape of cemented tungsten carbide or steel with the abrasive, or by coating a "precursor" shape and then cut that shape to obtain the one that is desired.

DESCRIPTION OF THE DRAWINGS

The present invention will be more clearly understood from the following detailed description of specific embodiment, read in conjunction with the accompanying drawings, wherein:

FIG. 1A is a perspective drawing illustrating a drill bit insert with an abrasive-faced curved contact surface portion.

FIG. 1B shows a simulated view of the abrasive-faced contact portion of the drill bit insert of FIG. 1A engaging material to be removed.

FIG. 1C is an end view of the drill bit insert in FIG. 1A showing the contour of the abrasive faced contact portion and the distal surface.

FIG. 2A is a perspective drawing illustrating a drill bit insert with an abrasive-faced curved contact portion which is non-symmetrical about the vertical axis of the insert.

FIG. 2B shows a simulated view of the abrasive-faced contact portion of the drill bit insert of FIG. 2A engaging material to be removed.

FIG. 2C is a cross section along line *2c—2c* in FIG. 2B showing the contour of the abrasive-faced contact portion.

FIG. 2D is a cross section along line *2d—2d* in FIG. 2B showing that the contour of the abrasive faced contact portion in this plane has differing radii of curvature than corresponding radii of curvature in the horizontal plane along *2c—2c*.

Figure 3A:
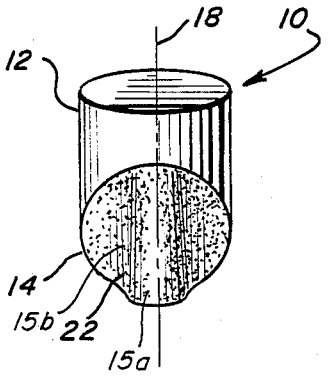
FIG. 3A is a perspective drawing illustrating a drill bit insert with an abrasive-faced curved contact portion symmetrical about the vertical axis of the insert.
Figure 3B:
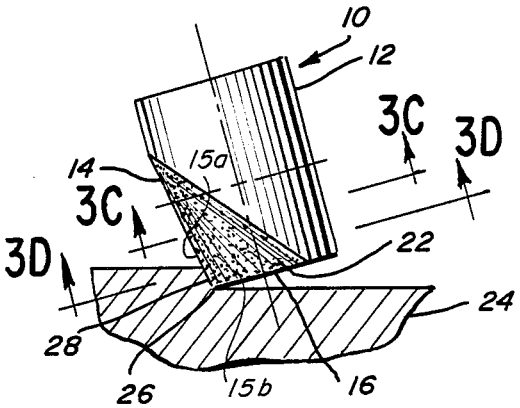
FIG. 3B shows a simulated view of the abrasive-faced contact portion of the drill bit insert of FIG. 3A engaging material to be removed.

It should be understood that the drawings are not necessarily to scale and that the embodiments are illustrated by graphic symbols, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION

FIG. 1A shows a drill bit engaging element in the form of an insert 10 made in accord with the present invention. As is well known, a plurality of drill bit inserts are positioned on the crown of a drill bit for use in mineral exploration or on site mining operations. Neither the drill bit itself nor the arrangement of the inserts on the crown are the subject matter of this invention and accordingly neither is shown in the drawing. However, it is within the ability of someone ordinarily skilled in the art to position the insert of the present invention in an appropriate drill bit.

The drill bit insert 10 comprises a shank portion 12, a contact portion 14 and a bottom surface 16 (refer to FIG. 1B). The drill bit insert 10 is commonly made from cemented tungsten carbide, but steel or any other similar material could be used. The insert 10 has a vertical axis indicated at 18 and a horizontal axis indicated at 20. In the most common form of drill bit the shank portion 12 fits into a recess formed on the drill bit crown (not shown) and is oriented so that the insert 10 has at a slightly negative angle A from the vertical during operation, refer to FIG. 1B.

An abrasive material, as defined herein, 22 is deposited upon the contact portion 14. The abrasive 22 is deposited by any known method and the method used does not form any part of this invention. In the preferred embodiment, the abrasive 22 is applied over a portion of the contact face 14 illustrated by the stippling in the drawing. The only restriction in the application of the abrasive 22 to the surface of the contact portion 14 is that the abrasive does not cover the distal or bottom end surface 16. However, the cost of the abrasive material 22 is quite small and a greater portion of the peripheral surface area of the contact portion 14 can be covered without departing from the scope of the present invention. It is also possible for the distal end to be covered at one stage of the production and then the portion of the distal end covered with abrasive is cut off, leaving a distal end which is not covered with abrasive.

The contour of the contact face is illustrated in FIG. 1C, which is a bottom view of the insert 10 of FIG. 1B. The area with the stippling illustrates the contour of the abrasive-faced contact area 22. In this embodiment the abrasive 22 is applied over an area which is one half of the curved surface of the contact portion 14 and up a height h along the vertical axis of the insert 10.

As the insert 10 is moved through the material 24 the work edge 26 of the contact portion 14 loosens the material 24 and the interface area 28 of the contact portion 14 also engages the material 24. As the material 24 is loosened it moves rearward along the curved surface of the contact face 14 away from both the work edge 26 and the interface area 28. The loosened material does not build up at or around the work edge 26 or the interface area 28 but rather, because of the curved shape of the contact portion 14, is moved away from the work edge 26 and away from the interface area 28 between the curved contact portion 14 and the material 24. Removing the loosened material from these two areas improves the life expectancy of the drill bit insert by eliminating the unnecessary regrinding of the backed-up material and by improving the drill bit's ability to dissipate heat and also makes the insert more effective in cutting new material. Furthermore, it is the applicant's current understanding that the material 24 both as it is engaged by the curved contact portion 14 and as it traverses along the curved surface of the contact portion 14 encounters stresses differing in magnitude, direction and/or type at each point along the curved surface which causes corresponding changes in magnitude, direction and/or type of strain in the material. If the material 24 is shale or some similarly plastic formation this additional straining causes it to chip, separate, and assume a granular texture which is more readily removed from the drilling hole by standard hydraulic operations.

As seen in FIGS. 1B and 1C, abrasive is not deposited upon the distal end or bottom surface 16 of the insert 10. The surface 16 is the cemented tungsten carbide or similar substance of insert 10. Since the cemented tungsten carbide is stronger than the abrasive material, it provides support to the abrasive material, but because the carbide is less wear-resistant than the abrasive 22, it will wear away in a controlled fashion relative to the abrasive 22, thereby maintaining a sharp cutting edge 26. Therefore, the contact portion 14 at the interface or work edge 26 is shelf-sharpening. Accordingly, the contact portion 14 maintains its ability to penetrate new material since the area 28 through which the contact portion impacts the new material 24 is kept relatively constant and does not increase with use.

In FIG. 2A another curved shape for the contact portion of the drill bit insert is shown. In FIG. 2A through 2D the same numbers are used to refer to the same structural elements as used for FIGS. 1A through 1C. The insert 10 comprises a shank portion 12 and a contact portion 14. Abrasive material 22 is deposited upon the contact portion 14 and the shape of the abrasive-faced contact portion is indicated by the stippling. The contour of the abrasive-faced contact portion 22, best shown in FIGS. 2C and 2D, is non-symmetrical about the vertical axis 18 of the insert 10 or the y-axis in the x-y grid of FIG. 2C. As viewed in FIGS. 2C and 2D, area 30 is greater than area 32. Accordingly, as this shaped insert passes through the material, more of the loosened material will pass through the second and third quadrants shown in FIG. 2C than will pass through the first.

The shape of the contact portion 14 forces material flow along area 30 which extends into the second and third quadrant of the circular cross-section in FIG. 2C. As the material moves across the surface wall 14 in area 30 it has stresses applied to it differing in magnitude, direction and/or type at each point along the curved surface. These changes in the applied stress cause additional straining of the material 24. When this material is shale and is subjected to the pressure and temperature of drilling it normally becomes plastic. This increased straining enhances the drill bit's ability to chip or granulate this plastic-like material and remove it from the hole by the normal flushing action of the drilling fluids.

FIG. 2D shows the shape of the non-symmetrically curved contact portion in cross section along line *2d—2d* in FIG. 2B. The abrasive faced contact portion is indicated by the stippling in FIG. 2D. The radius of curvature in the horizontal plane of the line *2d—2d* perpendicular to the vertical axis 18 may be different for each point on the surface of the contact portion 14 than the radius of curvature for the corresponding point on the surface of the contact portion 14 on the horizontal plane of the line *2c—2c*. The tapering or curved aspect of the contact portion 14 assists in directing the flow of loosened material into a predetermined direction.

In addition to the shape shown in FIG. 2 other designs can be employed to shape the curved contour of the contact face to direct material flow in a predetermined direction. With the loosened material directed into a preselected flow pattern the material removal from the drill hole can be more effective.

Figure 3C:
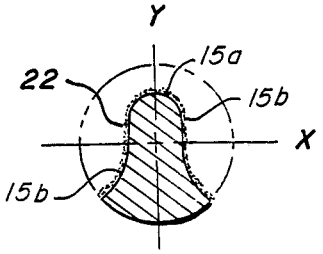
FIG. 3C is a cross section along line *3c—3c* on FIG. 3B showing the contour of the abrasive-faced contact portion.
Figure 3D:
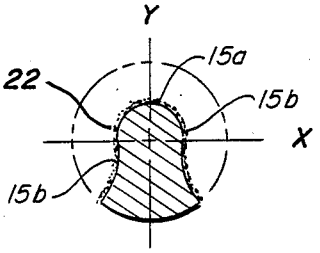
FIG. 3D is a cross section along *3d—3d* on FIG. 3B showing that the contour of the abrasive-faced contact portion in this plane has differing radii of curvature than corresponding radii of curvature in the horizontal plane along *3c—3c*.

In FIG. 3A another curved shape for the contact face of the drill bit insert is shown. In FIG. 3A though 3D the same numbers are used to refer to the same structural elements as are used for FIGS. 1A through 1C. The insert 10 comprises a shank portion and a contact portion having a blunt leading part 15*a* and two symmetrical side parts 15*b* adjacent thereto 14. Abrasive material 22 is deposited upon the contact portion 14 and is indicated by stippling in FIGS. 3A through 3D. The shape of the abrasive-faced contact portion 14, best shown in FIGS. 3C and 3D, is symmetrical about the vertical axis 18 of insert 10 or the y-axis in the x-y grid of FIGS. 3D and 3D. Furthermore, the radius of curvature from the center point of the insert to points on the surface of the contact portion 14 differs from point to point along the curve such that as shown in FIGS. 3C and 3D the blunt leading part 15*a* is convex in cross section and each of the adjacent side parts 15*b* are partially convex and partially concave in cross section. Also, the radius of curvature from the center point of the insert to a point on the surface of the contact portion differs for corresponding points lying in different horizontal planes. In one form this geometric feature results in a tapering toward the distal end 16. However, other shapes besides a taper can be obtained and the contact face portion which is either symmetrical or non-symmetrical about the vertical axis 18 can also be used. The tapering or curved aspect increases the straining of the material making it chip and separate more for improved removal from the drilling hole.

FIG. 3C shows the shape of the symmetrically curved contact portion in cross section along line 3*c*—3*c* in FIG. 3A. The abrasive-faced contact portion is indicated by the stippling in FIG. 3C. The radius of curvature in the horizontal plane of line 3*c*—3*c* perpendicular to the vertical axis 18 differs from point to point along the surface of right or left quadrant of the contact portion 14.

FIG. 3D shows the shape of the symmetrically curved contact portion in cross section along line 3*d*—3*d* in FIG. 3A. The abrasive-faced contact portion is indicated by the stippling in FIG. 3D. The radius of curvature in the horizontal plane of the line 3*d*—3*d* perpendicular to the vertical axis 18 may be different for each point on the surface of the contact portion 14 than the radius of curvature for the corresponding point on the surface of the contact portion 14 on the horizontal plane of the line 3*d*—3*c*.

Figure 4A:
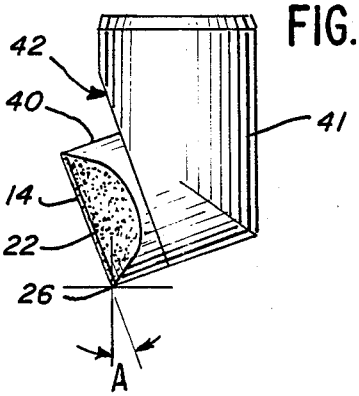
FIG. 4A shows a side view of a drill bit insert made in accord with the present invention wherein the insert is comprised of two pieces: an engaging element which includes the abrasive-faced contact portion fitted into the stud which forms the main shaft of the insert.
Figure 4B:
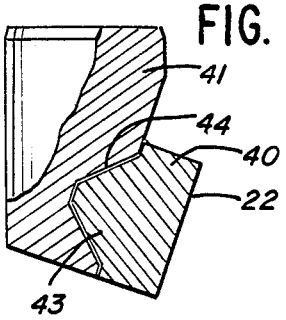
FIG. 4B is an elevational view of the reversed side of FIG. 4A with a portion broken away to expose the internal surfaces illustrating the attachment of the engaging element to the main shaft of the insert.

FIG. 4A is a side view of a drill bit insert made according to the present invention wherein the insert comprises two pieces: an engaging element 40 which includes the abrasive-faced contact portion 14 fitted into a stud 41 which forms the main shaft of the insert. As in the other embodiments described, the preferred material for the stud 41 and the body of the engaging element 40 is cemented tungsten carbide, however, steel or other hard materials may be used. Also, as with the other embodiments, abrasive 22 is applied to the contact portion 14 of the engaging element 40 is indicated by the stippling in FIGS. 4A and 4B. Such a two-piece arrangement as shown in FIGS. 4A and 4B is advantageous because it allows an abrasive-faced engaging element 40 to be attached to a stud 41 of a preselected length, thus lending greater flexibility in the design of such rotary type drag bits to account for such parameters as the desired depth of the cutting profile. Also, attaching the engaging element 40 to the angled face 42 of stud 41 provides the preselected negative rake A while allowing the insert's shaft to be placed perpendicularly into the crown, again giving greater flexibility to the design of this type of rotary drag bit. FIG. 4A also shows that the distal surface 16 is not coated with abrasive 22. The cutting edge 26 is thereby self-sharpening through the same process as described above.

FIG. 4B is an elevational view of the reversal side of the drill bit insert of FIG. 4A broken away to expose its internal surfaces and is included to show one method of attaching the engaging element 40 to a stud 41. The conical extension 43 of the engaging element 40 is formed to fit into the conical hole 44 in the stud 41. A braze may be used to form the actual attachment but is not the only contemplated means of securing the two pieces together.

From the above description, it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed is:

1. An insert for a rotary type drag bit for use in drilling through plastic-like material, said drag bit having a vertical axis and a horizontal axis perpendicular thereto, said insert comprising a shank portion for connection to the drag bit, a curved contact portion connected to said shank portion, an abrasive substance deposited over at least a portion of said curved contact portion for engaging the plastic-like material, and a free distal end surface upon which said abrasive material is not deposited, said curved contact portion having a blunt leading part and two symmetrical side parts adjacent thereto, said blunt leading part being convex in cross section perpendicular to the vertical axis and each of said symmetrical side parts being partially convex in cross section perpendicular to the vertical axis such that said curved contact portion is symmetrical about a plane coincident with said vertical axis and has a non-uniform radius of curvature about said vertical axis in each symmetrical side part of said curved contact portion for causing variations in the direction, magnitude or type of stress from point to point along said curved contact portion which provides a strain on said plastic-like material for removal of said plastic-like material.

2. An insert as set forth in claim 1 wherein said curved contact portion has a radius of curvature in one horizontal plane parallel to said horizontal axis being different than a corresponding radius of curvature in another horizontal plane parallel to said horizontal axis.

* * * * *

UNITED STATES PATENT AND TRADEMARK OFFICE

CERTIFICATE OF CORRECTION

PATENT NO. : 4,570,726

DATED : February 18, 1986

INVENTOR(S) : DAVID R. HALL

It is certified that error appears in the above-identified patent and that said Letters Patent is hereby corrected as shown below:

Column 1, line 33, "penetrations" should be --penetration--.

Column 6, line 12, "embodiment" should be --embodiments--.

Column 7, line 24, "has" should be --is--.

Column 9, line 13, "12" should be inserted after "portion".

Column 9, line 14, "14" should be inserted after "portion".

Column 9, line 21 "3D" (first occurrence) should be --3C--.

Column 9, line 56, "3d-3c" should be --3c-3c--.

Column 10, line 2, "and" should be inserted after "40"

Signed and Sealed this

*Eighth* Day of *July 1986*

[SEAL]

*Attest:*

DONALD J. QUIGG

*Attesting Officer*

*Commissioner of Patents and Trademarks*